United States Patent [19]

Higuchi

[11] 4,124,963

[45] Nov. 14, 1978

[54] METHOD FOR FORMING A CONTINUOUS FOOTING

[76] Inventor: Tadayasu Higuchi, 5-6-15, Sakuragaoka Setagaya-ku, Tokyo, Japan

[21] Appl. No.: 873,625

[22] Filed: Jan. 30, 1978

[30] Foreign Application Priority Data

Feb. 8, 1977 [JP] Japan ..... 52-12168

[51] Int. Cl.[2] ..... E04B 1/00

[52] U.S. Cl. ..... 52/742; 52/169.1; 52/292

[58] Field of Search ..... 52/742, 292, 293, 294, 52/169.1, 169.9

[56] References Cited

U.S. PATENT DOCUMENTS

| | | | |
|---|---|---|---|
| 2,129,211 | 9/1938 | Hickl | 52/294 |
| 2,228,763 | 1/1941 | Henderson | 52/294 X |
| 2,282,452 | 5/1942 | Brown | 52/742 |
| 2,722,040 | 11/1955 | Ludowici | 52/293 X |
| 2,780,935 | 2/1957 | Rumble | 52/742 |
| 3,848,377 | 11/1974 | Moni | 52/292 X |

*Primary Examiner*—Price C. Faw, Jr.
*Assistant Examiner*—Carl D. Friedman
*Attorney, Agent, or Firm*—Ladas, Parry, Von Gehr, Goldsmith & Deschamps

[57] ABSTRACT

A process for forming a continuous footing for building a house comprising digging trenches in accordance with the layout of a house to be built, forming a rubble and gravel bed in the trenches, placing a plurality of leveling pieces on the bed and leveling only the leveling pieces by laying sand thereunder, placing footing blocks on the leveling pieces so as to bridge them, pouring gravel in the trenches, compacting the gravel and rubble so that they are tightly compacted under the footing blocks up to the bottom of the footing blocks, thereafter removing the leveling pieces, and finally placing gravel in the spaces which have been occupied by the leveling pieces and compacting the gravel under the joints of the blocks, is disclosed.

4 Claims, 4 Drawing Figures

METHOD FOR FORMING A CONTINUOUS FOOTING

BACKGROUND OF THE INVENTION

This invention relates to a method for forming a continuous footing for building a house.

The conventional method for forming a continuous footing for building a house comprises digging trenches in accordance with the layout of the house to be built, placing rubble on the bottom of the trenches, compacting it by ramming, spreading gravel thereon, ramming the gravel, too, laying settling concrete thereon, forming frameworks for the footing on said concrete, pouring concrete in the framework to form a continuous footing, removing the frameworks after the concrete has hardened, and finishing the top surface of the formed continuous footing in order to level the whole top surface.

Recently, pre-fabricated footing blocks have come into use. When these pre-fabricated footing blocks are used, the rubble and gravel bed must be completely and perfectly leveled all over the continuous footing before the blocks are placed thereon. This leveling work requires much time and skill, so the benefit of using pre-fabricated blocks is offset. In the finishing work of leveling the bed for the footing, usually sand is laid on the bed for uniformly leveling the bed all over the layout of the house to be built. But this sand settles later and causes sinking of the footing per se. So far, compacting of the bed is performed by means of rammers. It is not known to use the vibration compactor for preparing the rubble and gravel bed for the footing to build a house.

This invention is intended to provide a simplified method for forming a continuous footing for building a house using pre-fabricated footing blocks.

SUMMARY OF THE INVENTION

According to this invention, a method for forming a continuous footing for building a house comprising digging trenches in accordance with the layout of a house to be built, placing rubble and gravel on the bottom of the trenches, leveling only the positions where the ends of each pre-fabricated footing blocks are to be placed by laying sand thereon, placing a base plate (slab) which I call "leveling piece" on each of said leveled positions, placing pre-fabricated footing blocks in the trenches so that each block bridges each two of the leveling pieces or two blocks form T junctions on the leveling pieces thus forming a continuous footing, supplying additional gravel to fill the spaces under the blocks and between the footing blocks and the sides of the trenches and compacting the bed under the blocks supplying additional gravel, thereafter removing the leveling pieces, and finally placing gravel in the spaces which have been occupied by the leveling pieces and compacting the bed at those positions, is provided.

The compacting of the bed is carried out by using a vibration compactor, for instance.

In carrying out this method, correlation between the power of the used vibrator and the weight of the blocks must be considered. When the bed under the blocks is compacted, if a vibration compactor is of too high power is used, it might dislocate the footing blocks which are in the proper places. Therefore, this method cannot be applied to the too small footing blocks.

When the positions, where one end of a block and one end of another block or one end of a block and the side of another block butt each other in alignment, in L shape or in T shape, are leveled, the level of each position can be adjusted after a leveling piece is placed on the bed by simply laying sand under the leveling piece. Because the leveling pieces are removed later, and gravel is added and compacted.

Therefore, the term of the continuous footing formation is remarkably shortened in comparision with the conventional method in which the rubble and gravel bed must be leveled all over the continuous footing. The continuous footing formed in accordance with the method of this invention is superior to the continuous footing formed by the prior art method in the settling test.

Now the invention is explained in detail with reference to the attached drawings.

DETAILED DESCRIPTION OF THE INVENTION

Figure 1:
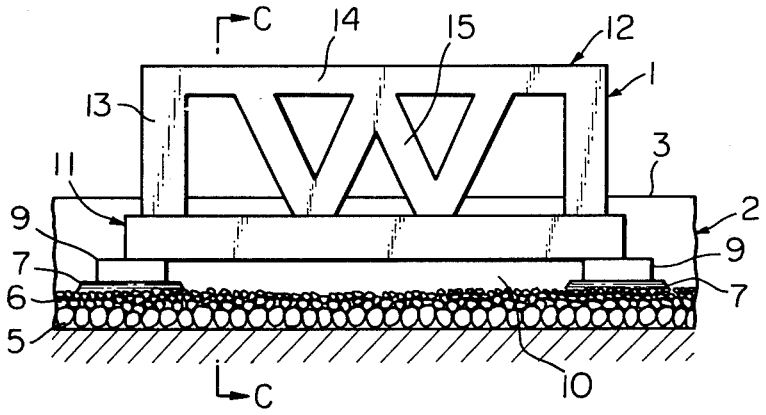
FIG. 1 is an elevational side view of a footing block which is placed on two leveling pieces bridging them, whereby the bed is shown as a cross section.
Figure 2:
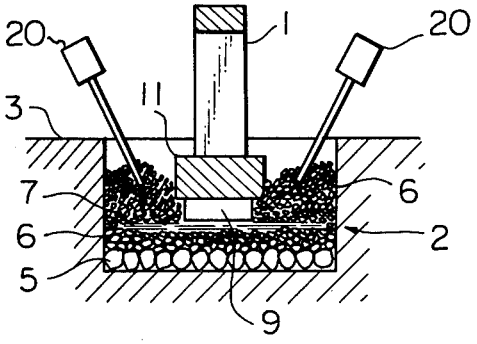
FIG. 2 is an elevational cross-sectional view of the footing block along the line C — C in FIG. 1. In this figure, two vibration compacters in operation are shown.

The footing block used in the method of this invention usually comprises a ridge 12 and a base slab 11. A typical pre-fabricated footing block is shown in FIGS. 1 and 2. In this footing block 1, the ridge 12 is not solid but comprises two end walls 13, a top solid web girder 14 and a plurality of slanting strut walls 15 with reinforcing rods incorporated. The length of the base slab 11 is 2700 mm, the width of the base slab is 300 mm, the total height is 670 mm, and the thickness of the base slab is 150 mm. The weight is 750 kg. In FIG. 1, reference number 3 stands for the earth surface. A trench 2 is dug in the ground and, first, rubble 5 is placed in the trench. Over the rubble, gravel 6 is spread. All the positions where the ends of the blocks are placed are leveled by laying sand or fine gravel 7 before or after leveling pieces 9 are placed. After all such positions are leveled, a leveling pieces 9 is placed on each position. The leveling piece is a square or rectangular thick concrete plate similar to the one used for pavement of the side walk of a street. The typical size thereof is 300 × 300 × 100 mm. Then footing blocks are placed on those leveling pieces so that each block bridges two leveling pieces or two blocks form a T junction or L junction on a leveling pieces and the blocks form a continuous footing.

Thereafter, gravel is poured into the spaces under the blocks and between the blocks and the sides of the trench, and the gravel is compacted together with the gravel and rubble which have been placed in the trench by means of the vibration compactor 20 as shown in FIG. 2. For 750 kg blocks, 0.4 KW electric vibration compactor is used without causing undesirable dislocation of the blocks. This is the vibration compacter used for compacting the railroad track bed.

After the bed under all the footing blocks has been well compacted, all the leveling pieces are removed. If the sand under the leveling pieces is removed, the pieces can easily be removed. Gravel is placed in the spaces where the leveling pieces have been placed, and these positions are well compacted by the vibration compacter, too. By these operations, a very stable continuous footing is formed.

Figure 3:
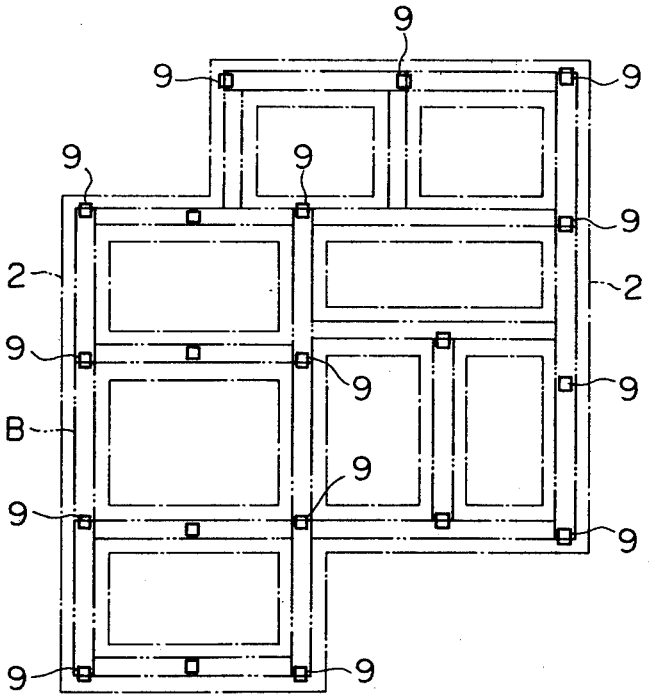
FIG. 3 is a plan view of a continuous footing wherein distribution of the leveling pieces are shown.
Figure 4:
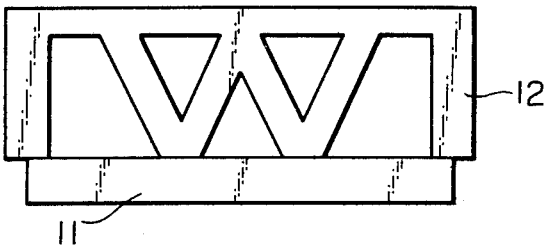
FIG. 4 is an elevational side view of a footing block of another form used in the method of this invention.

For the practical purpose, several kinds of footing blocks different in size, shape, and especially in length should be prepared. FIG. 3 shows an example of the layout of a house, wherein it is seen that leveling pieces are placed in the positions where the ends of two footing blocks butt each other in a straight line or in L shape or an end of a footing block abuts on the side of another block in T shape. In FIG. 3, trenches dug in accordance with the layout of the house are shown in one dot chain lines and aligned footing blocks are shown in two dot chain lines. From the distribution of the leveling pieces, it will be learned that footing blocks of different length are used. In FIG. 4, a pre-fabricated footing block of a different shape is shown. In this block, the base slab 11 is recessed at both ends, while in the block shown in FIG. 1, the base slab protrudes at both ends. These two blocks can be alternately arranged end-to-end in a straight line with the protruded ridge end of one block mounted on the protruded slab end of the other block. Or, the block shown in FIG. 4 can be arranged in T shape with its protruded ridge end mounted on the side edge of the base slab of another block. In the latter case, it is not always necessary to place a leveling piece under the T joint.

As has been explained in the above, according to this invention, the bed for the footing need not be leveled all over the layout of the house to be built. In the prior art method, the bed which has been leveled with much labor may be scraped and damaged by careless handling of the footing blocks when they are placed. In the method of this invention, placement and aligning of the footing blocks are carried out on the leveling pieces without touching the bed, and leveled compact bed is formed thereafter. In the prior art, formation of the bed for the footing was carried out by using rammers. In most cases, sand is used in the finishing work. Such sand settles later especially when a lot of rain falls, and causes sinking of the footing per se.

According to the method of this invention, the term for forming a continuous footing is reduced to less than one third of the prior art method using footing blocks. And that, the bed is well compacted under the already leveled footing blocks, and therefore, the formed footing hardly sinks.

In order to compare the compactness of the bed for the footing between the prior art method and the invention method, I carried out the following experiment. Two trenches 70 cm in width, 50 cm in depth and 4 m in length were dug in parallel with an approximately 2 meters space therebetween. Rubble was laid in the two trenches to the height (thickness) of about 10 cm. In one of the trenches, gravel was placed to the height of 25 cm from the bottom of the trench. In the other trench, gravel was placed to the height of 15 cm. (The thickness of the gravel is 5cm) In the first trench, the bed was rammed by the conventional rammer, sand being supplied, and carefully leveled and thereupon a footing block as shown in FIG. 1 was placed. In the second trench, the bed was roughly leveled by ramming. The two positions where the ends of the above-mentioned footing block were to be placed were carefully leveled by laying sand thereon. Thereafter two leveling pieces ($30 \times 30 \times 10$ cm) were placed respectively on the two leveled positions. The distance was 270 cm (length of the footing block). Then the above-mentioned footing block was placed so that it bridges the two leveling pieces.

Thereafter, gravel was further placed under and on both sides of the block and compacted by an electric vibration compacter of 0.4 KW, additional gravel being supplied. After the gravel was well packed to the level of the bottom of the footing block, the leveling pieces were removed. Gravel was supplied there and compacted in the same way. On each block a 4 ton weight was placed. The height of the top of the blocks was measured with a cathetometer placed on the stand provided between the two trenches. After 42 days, the first block showed 5 mm sinking at one end and 7 mm sinking at the other end. In contrast, for the second block, sinking was within 2 mm.

Having described my invention, I claim:

1. A method for forming a continuous footing for building a house comprising digging trenches in accordance with the layout of a house to be built, laying rubble and gravel on the bottom of the trenches, leveling only the positions where the ends of each pre-fabricated footing block are to be placed by laying sand thereon, placing a leveling piece (slab) on each of such positions, placing pre-fabricated footing blocks in the trenches so that each block bridges each two of the leveling pieces or two blocks form a T junction thus forming a continuous footing, supplying additional gravel to fill the spaces under the footing blocks and between the footing blocks and the sides of the trenches, compacting the rubble and gravel until they are tightly packed to the bottom of the blocks, thereafter removing the leveling pieces, and finally placing gravel in the spaces which have been occupied by the leveling pieces and compacting the bed at those positions.

2. The method for forming a continuous footing for building a house as described in claim 1, wherein compacting is performed by means of the vibration compacter.

3. The method for forming a continuous footing for building a house as described in claim 1, wherein a plurality of footing block which comprises a ridge and a base slab and the ridge protrudes at both ends thereof and a plurality of a footing block which comprises a ridge and a base slab and the base slab protrudes at both ends thereof are used in combination.

4. The method for forming a continuous footing for building a house as described in claim 2, wherein the rubble and gravel bed is rammed before the level pieces are placed.

* * * * *